343-756
5/5/87 OR 4,663,634

United States Patent [19]

Fulton

[11] Patent Number: 4,663,634

[45] Date of Patent: May 5, 1987

[54] POLARIZATION CONVERTER WITHIN WAVEGUIDE FEED FOR DISH REFLECTOR

[75] Inventor: David A. Fulton, Watertown, Mass.

[73] Assignee: Epsco, Incorporated, Westwood, Mass.

[21] Appl. No.: 553,684

[22] Filed: Nov. 21, 1983

[51] Int. Cl.[4] ..... H01Q 19/00; H01P 1/16

[52] U.S. Cl. ..... 343/756; 343/786; 333/21 A

[58] Field of Search ..... 343/756, 786; 333/21 A

[56] References Cited

U.S. PATENT DOCUMENTS 3,622,921 11/1971 Heeren ..... 333/21 A
4,414,516 11/1983 Howard ..... 333/21 A

*Primary Examiner*—Eli Lieberman
*Attorney, Agent, or Firm*—Donald Brown

[57] ABSTRACT

A microwave polarization converter for converting circular polarization to linear polarization or vice versa. The converter includes a fin and a shorting plate to effect such conversion.

11 Claims, 9 Drawing Figures

POLARIZATION CONVERTER WITHIN WAVEGUIDE FEED FOR DISH REFLECTOR

BACKGROUND OF THE INVENTION

This invention is directed to a system and method for selectively converting electromagnetic waves (signals) from circular to linear polarization or vice versa.

The invention herein is particularly useful in converting commercial satellite communications transmitted as circular polarized signals to linearly polarized signals so that home TV receivers may conveniently receive such signals. With the polarization converter of this invention it is also possible to receive linearly polarized signals if desired.

The present system may be remotely operated by the home owner (operator) to switch between different polarized transmissions from different or the same satellites, for example, from a satellite in the U.S.A. eastern time zone transmitting left hand circularly polarized microwave TV signals to a satellite in the U.S.A. central time zone transmitting right hand circularly polarized microwave TV signals. The system is not only inexpensive but also it provides polarization conversion with only about 1/10 of a db losses at the primary frequencies of interest, 10,000 GHz to 15,000 GHz, but also unexpectedly provides reception separation between left hand and right hand circularly polarized signals of at least about 15 to 20 db received by the converter at the same frequency.

It is to be understood that the system of the invention will operate over a broad range of microwave frequencies.

The converter may also be used for transmitting both circular or linear polarized signals.

BRIEF DESCRIPTION OF THE DISCLOSURE

Figure 1:
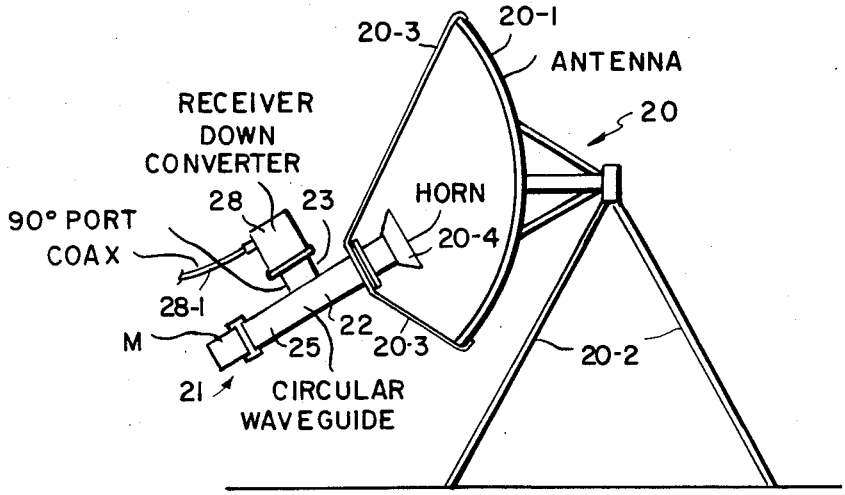
FIG. 1 is a side elevational view of the polarization converter supported by an antenna.

The polarization converter system of the invention includes a circular waveguide having a rectangular waveguide opening into the side thereof and forming a passage for microwave energy to pass between said waveguides. In proximity to said opening of said rectangular waveguide into said circular waveguide, there is positioned a metal fin and shorting member adjacent thereto for converting circularly polarized microwave energy entering said circular waveguide to linearly polarized microwave energy for transmission through the rectangular waveguide or converting linearly polarized microwave energy entering the rectangular waveguide and converting same to circularly polarized microwave energy for transmission from said circular waveguide.

The fin may if desired also be rotated to permit linearly polarized signals to be transmitted between waveguides without conversion.

DETAILED DESCRIPTION OF THE DISCLOSURE

Reference should now be had to FIGS. 1 to 5 which disclose a system for receiving microwave energy. At 20 there is shown an antenna system for receiving microwave energy transmitted, for example, by a communications satellite. The antenna 20 includes a dish 20-1 for collecting the transmitted microwave energy and focussing the collected energy at the horn 20-4. The horn 20-4 has a wide tapered mouth 20-4*a* gradually defining smaller interior circles and a narrower circular waveguide portion 20-4*b*. Both portions 20-4*a* and 20-4*b* have inner walls which are circularly shaped. The horn 20-4 is coupled by conventional flange connections to a circular waveguide 22 which is supported by members 20-3 coupled to the dish 20-1. The entire antenna complex is supported by a conventional tripod member 20-2 which may, e.g. be ground or roof-mounted. The circular waveguide 22 has a center line shown at 22-1. Extending from and opening into the circular waveguide 22 is a rectangular waveguide 23 (normally called a 90° port) having a center line 23-1 which is substantially perpendicular to the circular waveguide center line 22-1.

Microwave energy entering the horn 20-4 travels into the circular waveguide 22 and leaves from the rectangular waveguide outlet 23-3. The outlet end of the rectangular waveguide is coupled to a conventional receiver-down converter 28 which in turn is connected via a coax cable 28-1 to the user's receiver.

The receiver-down converter 28 conventionally used requires linear polarized microwave signals for operation, whereas satellites often transmit signals as circularly polarized signals (either left or right hand polarized). Accordingly, to convert the circularly polarized signal to a linearly polarized signal, an assembly 26 including a fin 26-1 of electrically conductive material, e.g. copper or aluminum, is positioned for rotation about the center line (axis) 22-1 of the circular waveguide 22. The face of the fin 26-1*a* is substantially flat and is at substantially a right angle to the axis 22-1 of the circular waveguide 22. In the preferred embodiment the fin 26-1 is conveniently mounted in a di-electric material 26-2, e.g. polystyrene, etc. for rotation about the axis 22-1. The di-electric material support 26-2 is positioned on a coupling member 24-3 which is itself coupled to a shaft 24-2 driven by an electric motor 24 (e.g. step or continuous) to position the fin 26-1 about the axis 22-1.

In the preferred embodiment the fin edge 26-1*a* is positioned preferably at $\frac{1}{4}$ (one quarter) of a wavelength from a circularly shaped metal shorting plate 27, e.g. copper, aluminum, etc. at the frequency to be converted to obtain the best conversion ratio. Where a band of frequencies is to be received, the 1/4 of a wavelength distance is usually based on the center frequency of the band. If the fin surface 26-1*a* is inwardly of the rectangular waveguide wall 23-5 i.e. to the left of FIG. 2, the bandwidth performance is unsatisfactory and if the fin 26-1*a* surface is positioned beyond the center line 23-1, i.e. to the right of FIG. 2, the incoming wave form is reflected to such a degree that the converter performance is unsatisfactory.

The fin 26-1 is positionable with respect to the shorting plate by adjusting the position of the coupler 24-3 on the shaft 24-2 by use of a set screw 24-3*a*. The shorting plate 27 as shown is mounted in a slidable manner in the circular waveguide portions 22-2 as shown by arrows 22-3 to position the shorting plate 27 and the fin 26-1 with respect to the inlet 23-4. In order to allow the flow of microwave energy without substantially reducing the amount of energy flow between waveguides, the fin face 26-1*a* is positioned between waveguide center line 23-1 and the proximal inner wall 23-5 of the rectangular waveguide 23.

Figure 2:
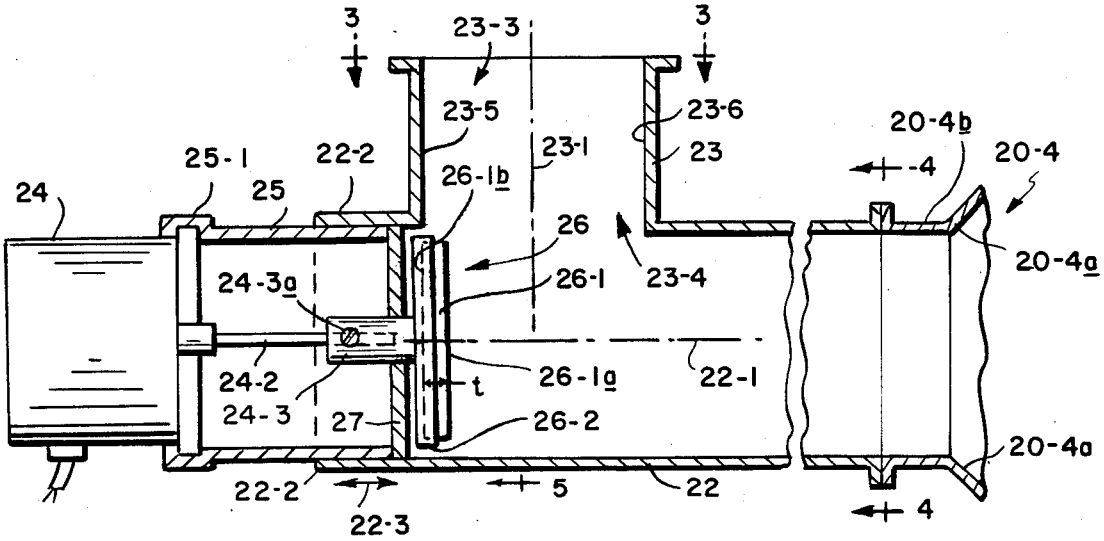
FIG. 2 is a sectional view of the converter taken from the top thereof.
Figure 3:
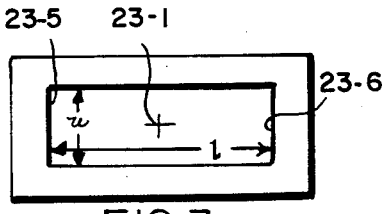
FIG. 3 is a view taken along line 3—3 of FIG. 2.
Figure 4:
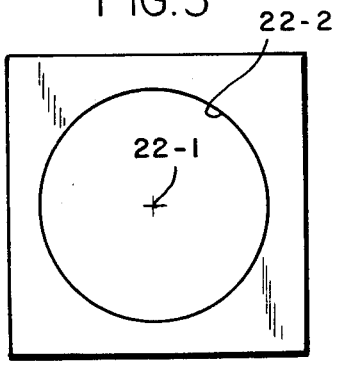
FIG. 4 is a view taken along line 4—4 in FIG. 2.
Figure 5:
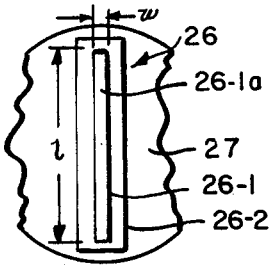
FIG. 5 is a view taken along line 5—5 in FIG. 2.
Figure 6A:
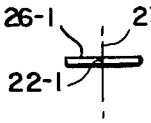
FIGS. 6A to 6D are views showing various angular positions that the fin is movable about the axis of the circular waveguide with respect to the center line of the rectangular waveguide.

The member 25 also supports the motor by way of flanges 25-1 and the coupling member is rotatable in a bearing sleeve 27-1. Thus in practice the fin surface 26-1*a* is always positioned between the center line 23-1 and the proximal wall 23-5 and the shorting plate 27 is preferably positioned to the left of the proximal wall 23-5 as shown in FIG. 2, however it may be positioned forward of the wall 23-5 and back of the center line 23-1. FIGS. 6A to 6D show four positions to which fin 26-1 is rotatably positionable about axis 22-1. In FIGS. 6A to 6D the fin 26-1 is 90° to the center line 23-1 or parallel thereto and in such positions linearly polarized microwave energy entering the horn 20-4 will travel through rectangular waveguide 22 and be directed into rectangular wavguide 23 without having its polarization changed. With the fin 26-1 as shown in FIGS. 6A and 6D, circularly polarized signals entering the horn 20-4 will be substantially reflected back with the remainder entering the rectangular waveguide.

Figure 6B:
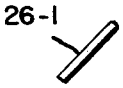
Figure 6C:
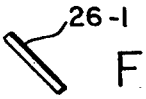
Figure 6D:
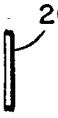

When the fin 26-1 is at ±45° to the center line 23-1 as shown in FIGS. 6B and 6C, circularly polarized microwave energy signals (LH and RH) entering the horn 20-4 will be converted to linearly polarized microwave energy. With the fin 26-1 positioned as in FIG. 6B (45° to the center line 23-1right hand (RH) circularly polarized microwave signals will be converted to linearly polarized microwave signals and the fin 26-1 as positioned in FIG. 6C will be converted to left hand (LH) circularly polarized microwave signals to linearly polarized signals, thus providing the linearly polarized signals which then pass through the rectangular waveguide and are accepted by the receiver 28. It should be understood that the converter of this invention may also be used in a transmitter mode by replacing the receiver 28 with a transmitter. Thus linearly polarized transmitted microwave signals now entering rectangular waveguide at 23-3 may be converted to circularly polarized microwave energy by positioning the fins as shown in either FIGS. 6B or 6C for transmission from the circular waveguide 22 through horn 20-4 against the dish 20-1 for beaming at e.g. a communications satellite.

Likewise, transmitted linearly polarized microwave signals entering the rectangular waveguide 23 may be transmitted as linearly polarized signals by the antenna without a change in polarization by positioning the fin as shown in either FIGS. 6A or 6D.

It has been found that for a bandwidth of 11.7–12.7 GHz with a center frequency of 12.2 GHz the fin face 26-1*a* should be 0.525 inches from the shorting plate 27 and it is preferred that the fin face by positioned to the right of wall 23-5 about 0.105" inches. It should also be understood that the fin may be directly driven by the coupling member by the shaft. The plate 27 may be of a thickness of 25 mils and a fin 26 having a width dimension (w) of 0.020 inches, a length (1) dimension of 0.605 inches and a thickness (t) of 0.225 inches has been found adequate using a circular waveguide 22 of an inner diameter 0.622 inches and a rectangular waveguide 23 of an inner length dimension (1) 0.750 inches between walls 23-5 and 23-6 and width (w) dimension 0.093 inches is satisfactory.

It should also be understood that the fin thickness as well as the other dimensions may be varied as will be appreciated, and it is understood that the dimensions given are only by way of example for the preferred embodiment at this time.

What is claimed is:

1. A system comprising a polarization converter including a circular waveguide, a rectangular waveguide having an opening for receiving or transmitting a signal, said rectangular waveguide opening into a side wall of the circular waveguide, the center line of the rectangular waveguide being at substantially a right angle to the axis of said circular waveguide, a unit comprising a metal fin and a shorting member positioned in said circular waveguide at the opening of said rectangular waveguide into said circular waveguide, said fin being a preset distance from said shorting member, and said fin being movable with respect to said center line of said rectangular waveguide about the axis of said circular waveguide with the face thereof substantially at right angles to the axis of the circular waveguide, said fin having a front edge positioned between the rectangular waveguide center line and the wall of said rectangular waveguide farthest from the circular waveguide opening and means providing circularly polarized microwave signals to the circular waveguide.

2. The system according to claim 1 in which an antenna horn is coupled to the opening to the circular waveguide.

3. The system according to claim 2 in which a receiver-down converter is coupled to the rectangular waveguide at the outlet thereof.

4. A system comprising a dish antenna, a horn positioned to receive reflected microwave energy from said antenna or provide microwave energy to be reflected by said antenna, said horn coupled to the inlet of the circular waveguide of the system of claim 1.

5. The system of claim 1 in which the fin is positioned between the center line of said rectangular waveguide and the proximal inner side of the waveguide which is at right angles to the axis of the circular waveguide.

6. A system comprising an antenna, a circular waveguide coupled to said antenna and having an opening for receiving and transmitting a circularly polarized microwave signal to or from said antenna, a rectangular waveguide having a rear wall farthest away from said opening, said rectangular waveguide coupled to and opening into a sidewall of said circular waveguide, and a metal fin and a shorting member spaced therefrom positioned at the opening of said rectangular waveguide into said circular waveguide with the shorting member positioned with respect to said metal fin so that microwave energy traveling in said waveguides in either direction initially encounters said fin, said shorting member positioned inwardly of said rear wall and said metal fin positioned between said rear wall and the center line of said rectangular waveguide.

7. The system of claim 6 including means for rotating said fin about the axis of said circular waveguide.

8. The system of claim 7 in which a face of the fin is perpendicular to the axis of said circular waveguide.

9. A system for converting a circularly polarized input microwave signal to a linear polarized signal comprising a polarization converter comprising a circular waveguide having an inlet end for the reception of microwave energy, said circular waveguide being closed at its other end by a unit comprising a shorting member and a metal fin rotatable about an axis of said circular waveguide, said fin being spaced closer to said inlet than said shorting member and said fin being spaced a predetermined distance from said shorting member depending upon the wavelength of the frequency of the signal whose polarization is to be converted, and a rectangular waveguide having an outlet end and an inlet end, said rectangular waveguide at its inlet end opening into said circular waveguide in the portion of the circular waveguide where the fin and shorting member are located, the center line of the rectangular waveguide being nearer the inlet end of the circular waveguide than said unit, and means providing circularly polarized signals to the circular waveguide.

10. The converter of claim 9 in which the center line of the rectangular waveguide is substantially perpendicular to the axis of said circular waveguide.

11. The converter of claim 9 or 10 in which a motor is coupled to the fin to rotate it about the axis whereby circularly polarized energy may be converted to linear polarized energy which exits from the outlet end of said rectangular waveguide.

* * * * *